United States Patent [19]

Kawamura et al.

[11] 4,122,797

[45] Oct. 31, 1978

[54] ULTRASONIC SOUND SOURCE AND METHOD FOR MANUFACTURING RECTANGULAR DIAPHRAGM OF ULTRASONIC SOUND SOURCE

[75] Inventors: Masatada Kawamura, Hoya; Hiroyuki Yamane, Yono, both of Japan

[73] Assignee: Kurashiki Boseki Kabushiki Kaisha, Okayama, Japan

[21] Appl. No.: 728,883

[22] Filed: Oct. 1, 1976

[30] Foreign Application Priority Data

| | | | |
|---|---|---|---|
| Mar. 25, 1976 | [JP] | Japan | 51/33236 |
| Mar. 25, 1976 | [JP] | Japan | 51/33237 |
| Sep. 10, 1976 | [JP] | Japan | 51/122357[U] |

[51] Int. Cl.[2] ..... B06B 1/02; B06B 1/10

[52] U.S. Cl. ..... 116/137 A; 29/594; 74/155

[58] Field of Search ..... 116/137 A, 137 R; 34/DIG. 14, 4, 17; 134/1; 74/1 SS; 29/407, 594; 84/402, 403, 405, 408, 409, 410; 181/173; 55/277; 340/384 R

[56] References Cited

U.S. PATENT DOCUMENTS

| | | | |
|---|---|---|---|
| 3,019,660 | 2/1962 | Welkowitz | 134/1 |
| 3,019,661 | 2/1962 | Welkowitz | 134/1 |
| 3,160,138 | 12/1964 | Platzman | 116/137 A |
| 3,173,034 | 3/1965 | Dickey | 134/1 |
| 3,252,336 | 5/1966 | Eisner | 74/1 |
| 3,525,884 | 8/1970 | Onoe | 84/409 |

OTHER PUBLICATIONS

"Physics" Hausmann et al., pp. 552, 553; Copyright 1935, 1939.

*Primary Examiner*—S. Clement Swisher
*Assistant Examiner*—Denis E. Corr
*Attorney, Agent, or Firm*—Wenderoth, Lind & Ponack

[57] ABSTRACT

The present invention is directed to an ultrasonic sound source made up of diaphragms composed of rectangular plates adapted, in dimensions, to vibrate in a stripes mode, and mounted, in spaced relation and in multiple stages, on a longitudinal resonance rod which is connected to the horn of the vibrator to produce the ultrasonic waves above the audio-frequency. Thus, an intense ultrasonic sound source which is free from noises and is superior in radiation efficiency is provided.

10 Claims, 22 Drawing Figures

FIG. 6
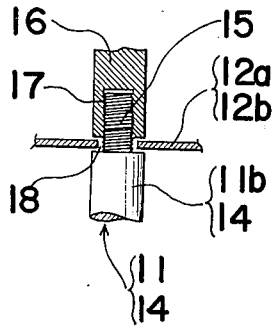
FIG. 7(a)
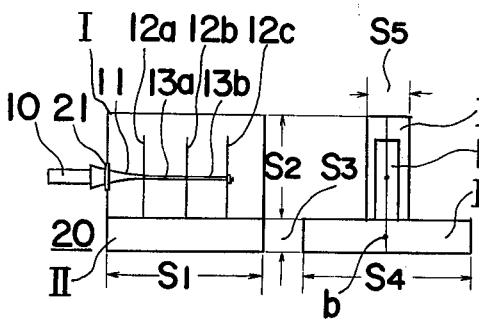
FIG. 7(b)
FIG. 8 (I)
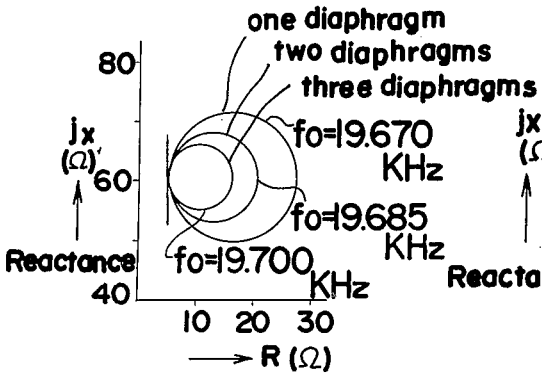
FIG. 8 (II)
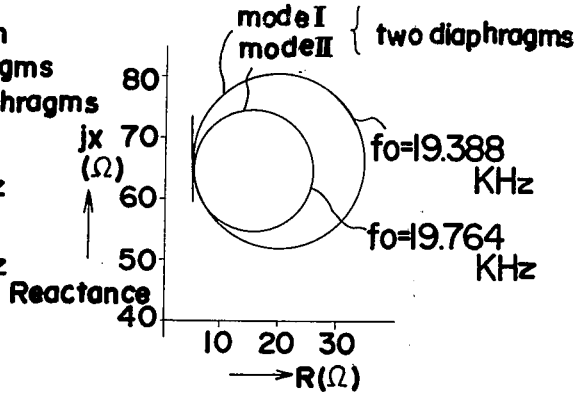
FIG. 9
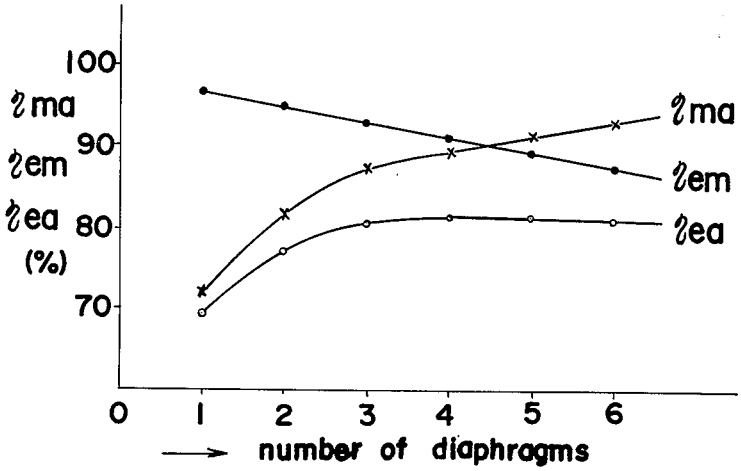

FIG. 10 (I) FIG. 10 (II) FIG. 10 (III)
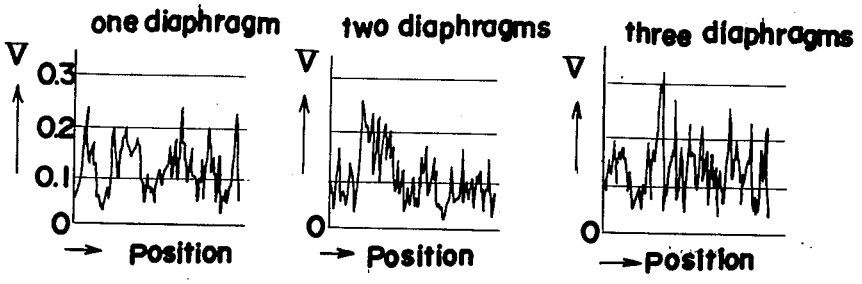
FIG. 11
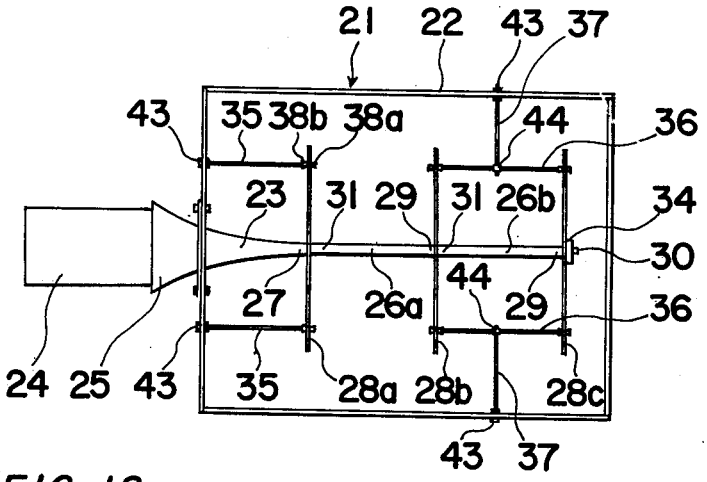
FIG. 12
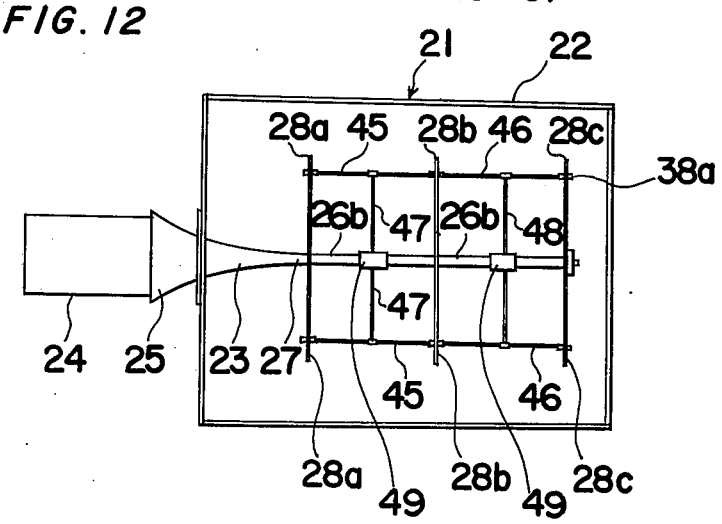

ULTRASONIC SOUND SOURCE AND METHOD FOR MANUFACTURING RECTANGULAR DIAPHRAGM OF ULTRASONIC SOUND SOURCE

The present invention relates to an ultrasonic sound source, and a method of manufacturing a rectangular diaphragm for use in an ultrasonic sound source in air intended for dust-coagulating or drying, etc. More particularly, the invention relates to an ultrasonic sound source which is composed of a plurality of rectangular diaphragms each vibrating in a stripes mode and mounted in multiple stages and in spaced relation, on a vibrator with a horn thereon, and which is free from noise pollution, superior in radiation efficiency and capable of producing an intense sound field, and relates to a method of easily and efficiently manufacturing a rectangular diaphragm vibrating in a stripes mode and which has superior ultrasonic radiation efficiency for its size or shape.

Generally, for example, aerosol coagulation or sonic drying is a known application of an intense sound field in air. However, the practical use thereof has not been achieved. This is because, in practice, in the range of audio-frequency (1 to 10 KHz) and at a high level (150 dB or more), a noise problem always occured. Although a siren of high efficiency has been developed, the production of compressed air, the processing thereof, and especially the high level of audible sounds which are produced accompanying the ultrasonic frequency, result in difficulties. In addition, there is one device in which the ultrasonic sound source is used for dust-coagulating through the combination thereof with an electrostatic precipitator. But this device is unsatisfactory with respect to its radiation efficiency.

The present inventors have discovered interesting facts such as listed below, in the course of the practical-use research relating to an ultrasonic sound source, for use, particularly, in aerosol coagulation, drying of objects which must not be subject to high temperatures, communication using sound waves and so on.

1. In order to obtain an intense sound field, it is necessary to increase the area and vibration amplitude of the diaphragm. At a fixed frequency, with an increase of the vibration amplitude of the diaphragm, the sound pressure level increases. However, the increase of the vibration amplitude is limited by the fatigue strength of the diaphragm.

2. For the same area and vibration amplitude, a rectangular diaphragm can produce more intense air-borne ultrasonic waves than a circular diaphragm can.

3. With respect to the same electric input power a rectangular diaphragm which vibrates in a stripes mode in which vibration occurs within approximately equally-spaced parallel nodal lines has the best radiation efficiency for a given electric input power, as compared with other diaphragms which produce the other modes.

4. In a rectangular diaphragm which produces the stripes mode, the sound pressure level is saturated when the area of the diaphragm is over the threshold value.

5. An intense sound field is easily obtained by increasing the number of the sound sources, namely, the number of the diaphragms.

The present invention seeks to provide, according to the above knowledge, an intense ultrasonic sound source composed of a diaphragm which is free from noise and has superior radiation efficiency. The arrangement of the present invention is capable of producing stripes mode vibration superior with a radiation efficiency superior to that of other vibrating modes, and can also develop aerial supersonic waves stronger than those developed by a disc type vibration mode. The present invention is characterized in the designing thereof for determining dimensions of the rectangular diaphragm based on an experimentally confirmed formula, with consequent elimination of repetition of troublesome cut and try procedures conventionally required. According to the present invention there is provided an ultrasonic sound source comprising one set of rectangular diaphragms each having dimensions of length $l_L$ in a direction perpendicular to nodal lines of the stripes mode vibration and width $l_W$ in the direction of the nodal lines of the stripes mode vibration, said dimensions being determined by the following equations under conditions for developing the stripes mode vibration;

$$l_L = (N - \tfrac{1}{2})\cdot d$$

$$l_W = N'\cdot d$$

wherein $N$ is the number of optional even numbered nodal lines of the stripes mode vibration, $N'$ is an optional odd number smaller than the value of N, and $d$ is the distance between nodal lines of the stripes mode vibration, longitudinal resonance rod and a horn with a vibrator, said one set of rectangular diaphragms being secured to a longitudinal resonance rod member which is fixed to the small end of said horn. In the ultrasonic sound source, the diaphragm which constitutes one portion of the ultrasonic sound source is composed of a rectangular plate having dimensions to vibrate in a stripes mode, and three or four rectangular diaphragms of the above dimensions are mounted, in spaced relation and in multiple stages, on a longitudinal resonance rod which is connected to the horn of the vibrator, or on the small end of the horn to produce ultrasonic waves above the audio-frequency.

A better understanding of the present invention may be had from the following full description thereof when read in reference to the attached drawings, and FIG. 1 is a front view of an ultrasonic sound source hereinbefore described, wherein a rectangular diaphragm is fixed to the small end to a horn of a vibrator;

FIG. 6 is a cross-sectional view showing the connection of the horn, a longitudinal resonance rod, and the rectangular diaphragm;

Figure 13:
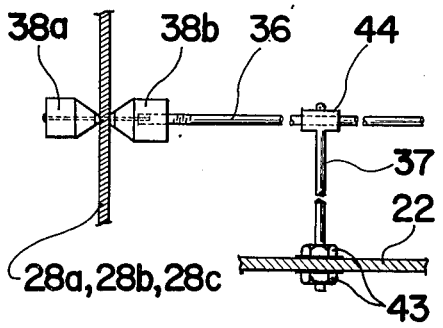
Figure 14:
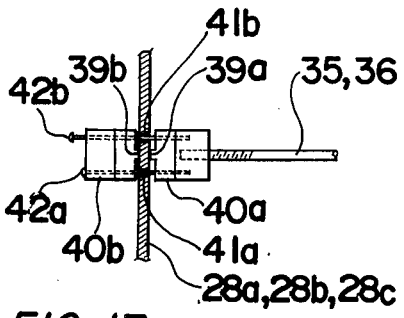

FIGS. 7(*a*) and 7(*b*) are schematic front views of an apparatus for carrying out experiments relating to the present invention;

FIG. 8(I) is a graph showing the results of tests to determine the free impedance measured from the electric terminal of the sound source where the number of the stripes mode vibrating rectangular diaphragms is changed;

FIG. 8(II) is a graph similar to FIG. 8(I), showing the results where the rectangular diaphragm vibrating in other than the stripes mode is used;

FIG. 9 is a graph showing electro-mechanical efficiency, mechano-acoustical efficiency, and electro acoustical efficiency where the number of the rectangular diaphragms of the ultrasonic sound source is changed;

FIGS. 10(I), 10(II) and 10(III) are graphs each showing the sound source pressure where the number of the rectangular diaphragms of the ultrasonic sound source in the experimental apparatus of FIG. 7 is changed;

FIG. 11 is a front view showing another embodiment of an ultrasonic sound source in accordance with the present invention;

FIG. 12 is a front view showing still another embodiment of the present invention;

FIG. 13 is an enlarged sectional view showing, in detail, the connections among the rectangular diaphragms, coupling rods, and a sound source of the device showing in FIG. 11;

FIG. 14 is an enlarged sectional view similar to FIG. 13;

ways of producing an intense sound field with the ultrasonic sound source of this system.

Figure 4:
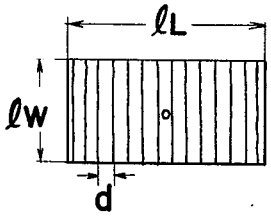
FIG. 4 is a plan view showing a condition in which the stripes mode vibration occurs in the rectangular diaphragm of FIG. 1.

Namely, the centrally-driven rectangular diaphragm used in the ultrasonic sound source of the system effects various vibration modes of flexural vibration due to the size of the diaphragm or the driving frequency thereof. Experimental results concerning the relation between the modes and the radiation efficiency of the ultrasonic waves indicate that the driving at the resonance frequency in a flexural vibration mode in which the diaphragm vibrates around approximately equally-spaced nodal lines extending perpendicular to the long side of the rectangular diaphragm, so as to produce transverse lines of black carbon particles spaced on the diaphragm, as shown in FIG. 4, and hereinafter called the striped mode, provides superior radiation efficiency of the ultrasonic waves for the same electrical input power as compared with other modes such as a mode wherein nodal lines are non-uniformly spaced, or a rectangular mode.

In order to prove the foregoing, the experimental results obtained by the present inventors are shown for one example in the following table (Table 1).

Table 1

| Size of rectangular diaphragm (length × width) mm | 197 × 73 | | 199.5 × 74 | | 201 × 75 | |
|---|---|---|---|---|---|---|
| Frequency (KHz) | 19.261 | 18.896 | 18.910 | 18.526 | 18.701 | 18.300 |
| Mode | Stripes mode | Rectangular mode | Stripes mode | Rectangular mode | Stripes mode | Rectangular mode |
| Efficiency(%) | 72.5 | 50.7 | 77.3 | 66.2 | 79.9 | 59.0 |
| Current (A) | 0.39 | 0.1 or less | 0.1 or less | 0.14 | 0.2 | 0.1 or less |
| Sound radiation | Good | Bad | Slightly Good | Slightly Good | Good | Slightly Good |
| Resonance frequency (KHz) of longitudinal vibration system | 18.920 | | 18.920 | | 18.296 | |

Input Power 1W
Receptacle on which ultrasonic sound source is mounted : 500 × 500 × 200 ($mm^3$)
Plate material of rectangular diaphragm : duralumin (plate thickness 1 mm)

Figure 15:
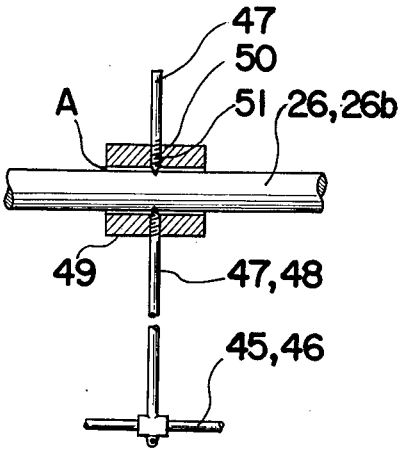
Figure 16:
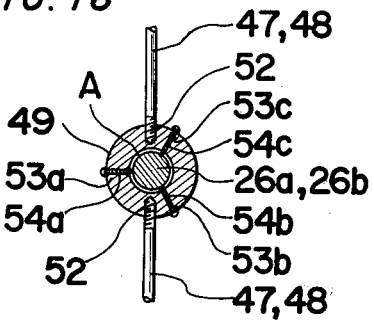
Figure 17:
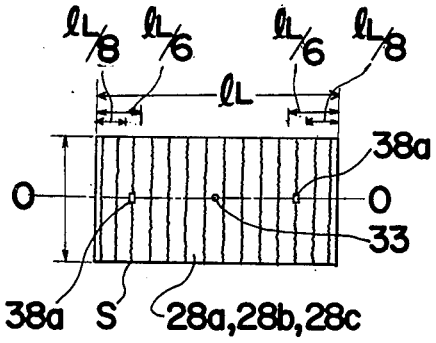
Figure 18:
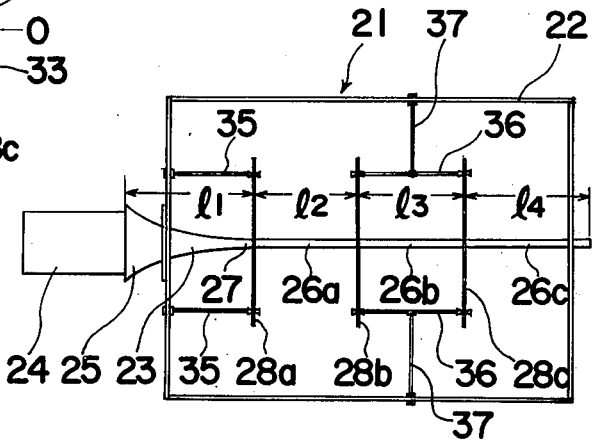

FIG. 15 is an enlarged cross-sectional view showing, in detail, the connections between the longitudinal resonance rod and the coupling rods in FIG. 12;

FIG. 16 is an enlarged sectional view showing a modified example of the connections between the longitudinal resonance rod and the coupling rods in FIG. 15;

FIG. 17 is an end view showing the positional relation of the horn, or the longitudinal resonance rod, and the stationary members with respect to the diaphragm; and FIG. 18 is a front view similar to FIG. 11, showing an ultrasonic sound source for an experiment.

The rectangular diaphragm for use in the ultrasonic sound source of the invention is manufactured in accordance with a method as described hereinafter.

Figure 1:
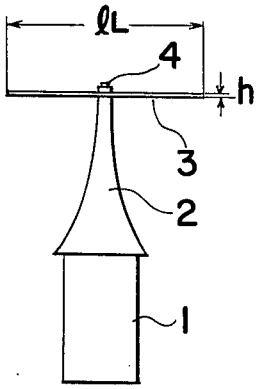
Figure 2:
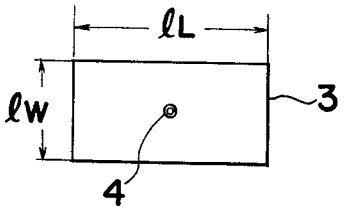
FIG. 2 is a plan view of the sound source of FIG. 1.

As shown in FIGS. 1 and 2, as one ultrasonic sound source, there is known an ultrasonic sound source wherein a rectangular diaphragm 3 is held by a nut 4 at central portion thereof to the small end of a horn 2, which is provided with a vibrator 1 such as a magnetostrictive vibrator, etc., so as to transmit the vibration of the vibrator 1 to the horn and to drive the central portion of the rectangular diaphragm to generate the ultrasonic waves.

In general, it is considered difficult to produce intense ultrasonic waves due to acoustic impedance and inferior electro-acoustic efficiency when a magnetostrictive vibrator, etc. is used to produce ultrasonic waves in the air. The present inventors have discovered the following facts in the process of conducting research into It is preferable that a stripes mode vibrating rectangular diaphragm be used to provide the intense ultrasonic sound source. However, it is very difficult theoretically to manufacture a free-edge rectangular diaphragm which vibrates flexurally in the stripes mode. A so-called cut-and-try method wherein vibration mode observations and cutting of the rectangular diaphragm are repeated must be adopted with respect to an optional rectangular diaphragm material the physical constant of which is unknown.

After further research, the present inventors have discovered a method by which a rectangular diaphragm which is superior in radiation efficiency for ultrasonic waves can be manufactured extremely easily, after one experiment, even if the material constant is unknown. Namely, the manufacturing method in accordance with the present invention comprises the steps of using an experimental rectangular vibrator of the same material as that of the rectangular diaphragm to be manufactured for producing vibration in the stripes mode thereon, obtaining the physical constant peculiar to the rectangular diaphragm from the experimental results, determining the length and width of the rectangular diaphragm for producing the desired vibration by use of an equation discovered by the present inventors, and providing complete stripes mode vibration based on the values obtained. The present invention provides variously-shaped rectangular diaphragms which are superior in radiation efficiency for ultrasonic waves.

More particularly, in a process wherein the physical constant peculiar to the rectangular diaphragm is obtained, the experimental rectangular diaphragm is used to produce complete stripes modes vibration of the diaphragm experimentally. The dimensional conditions of the experimental rectangular diaphragm are such that $l_1$: the length of the rectangular diaphragm perpendicular to the nodal lines of the stripes mode vibration, $f_1$: the resonance frequency of the rectangular diaphragm, $N_1$: the number (even number) of the nodal lines of the stripes mode vibration appearing on the rectangular diaphragm, and $h_1$: the thickness of the rectangular diaphragm.

From known theoretical equations (for example, page 136, Introduction To Mathematical Acoustics, written by Yamashita, and published by Sankai-do Corp. of Japan) concerning the flexural vibration of a free-edge rectangular cross-section bar, $$l = (N - \tfrac{1}{2})\cdot d \quad (1)$$

$$d = \{\pi\cdot C_D\cdot h\}/2f^{\frac{1}{2}} \quad (2)$$

wherein $d$ is the spacing between the nodal lines in appearing on the rectangular section bar in the stripes mode vibration the following theoretical equation is derived, $$C_D = (2f\cdot l^2)/(N-\tfrac{1}{2})^2\pi\cdot h \quad (3)$$

The above described values $l, f, N$, and $h$, are substituted into the equation (3) for terms $l, f, N$ and $h$ to obtain the physical constant $C_D$ peculiar to the material of the rectangular diaphragm.

The above described equations (1), (2) and (3) are equations for a rectangular cross-section bar, and can be applied even to a plate having the shape of a rectangular diaphragm to be used in this invention. Also, conversely the rectangular cross-section bar may be used as a substitute for the experimental rectangular diaphragm. Thus, the physical constant can be determined positively without using the general equation $$C_D = \{\frac{E}{12\rho\,(1-\sigma^2)}\}^{\frac{1}{2}} \quad (4)$$

for the physical constant $C_D$ of the rectangular diaphragm, wherein $E$ is the Young's modulus, $\rho$ is the density, and $\sigma$ is the Poisson's ratio of the material, respectively. As it is generally difficult to correctly obtain the Young's modulus, the density $\rho$ and the Poisson's ratio $\sigma$ of the material, respectively, the value of the physical constant $C_D$ obtained from such values are inaccurate. According to the present invention, the physical constant $C_D$ can be obtained easily and correctly even when the quality of the material of the rectangular diaphragm is unknown.

The length $l_L$ in the direction perpendicular to the nodal lines in the stripes mode vibration, and the width $l_W$ in the nodal line direction of the rectangular diaphragm to be manufactured of a material having a value of the physical constant $C_D$ obtained by the above described process are obtained, under the given conditions, by using the desired dimension of the thickness $h_2$ of the rectangular diaphragm, the resonance frequency $f_2$ of the horn to be used, the number $N_2$ of the optional even-numbered nodal lines of the stripes mode vibration which are to be present on the rectangular diaphragm, and the optional odd number $N'_2$, which is smaller than the number $N_2$, by inserting these values into the following equations concerning the flexural vibration of the rectangular diaphragm discovered by the present inventors for the values $h, f$, N and N', respectively, $$l_L = (N - \tfrac{1}{2})\,\{\frac{\pi\cdot C_D\cdot h}{2f}\}^{\frac{1}{2}} \quad (5)$$

$$l_W = N'\cdot\{\frac{\pi\cdot C_D\cdot h}{2f}\}^{\frac{1}{2}} \quad (6)$$

In producing the complete stripes mode vibration of the rectangular diaphragm, the dimensional relation between the length $l_L$ of the rectangular diaphragm and the width $l_W$ thereof is determined by the values of the above $h_2, f_2, N_2, N'_2$ and a given physical constant $C_D$.

The above described theoretical equations (5) and (6) concerning the flexural vibration of the rectangular diaphragm were obtained during the experimental steps as described hereinafter.

An experiment was carried out to determine the sizes of the sides of a stripes mode vibrating rectangular diaphragm for a simple case where the parallel nodal lines did not appear in the direction of the long side, namely, for a case where the width was smaller than the space between the nodal lines. Namely, in this experiment, the ratio between the length of the long side and the space between nodal lines which in the stripes mode vibration are produced in a direction perpendicular to the long side direction is taken into consideration to check what the value of the size of the long side is when a complete stripes mode vibration is produced or what the value of the size of the long side is when it is difficult to produce the vibration.

In the experiment wherein the both ends of the rectangular diaphragm were cut off little by little during the progress of the experiment, the length of the long side was changed, while maintaining the width of the rectangular diaphragm constant at 8 mm. A resonance frequency of 54.1 KHz was obtained from a vibrator with a horn. The experimental method comprised the steps of fastening the central portion of the rectangular diaphragm, with a nut, to the small end of the horn, so as to vibrate it at a frequency at a given value of 34.00 KHz, and obtaining the absolute value $|Z_f|$ of the free impedance as seen from electric terminal at a given current (0.2 A). Also, at this time, the sand figure of Mr. Ernst Florens Fiedrich Chladni's chart was also checked. As a result of the measurement, it was found out that the absolute value $|Z_f|$ of the free impedance of the drawing is considered to correspond to the change of the mechanical impedance of the diaphragm seen from the small end of the horn. The arrows $N = 8$ and $N = 10$ in FIG. 3 indicate that eight or ten equally-spaced stripe-shaped nodal lines appear along the length of the rectangular diaphragm, respectively. Referring to the horizontal axis of FIG. 3, the curve has a valley at $N = 7.5$ and $N = 9.5$ if N is considered as a numeral which changes continuously. At the points corresponding to the valleys, the mechanical impedance of the rectangular diaphragm as seen from the horn small end is extremely large. Accordingly, the flexural vibration is considered to be difficult to produce.

Figure 3:
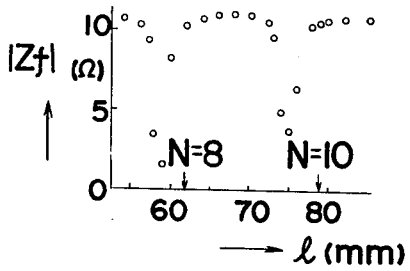
FIG. 3 is a graph showing the relationship between the absolute value of free impedance and the length of the rectangular diaphragm of FIG. 1.

From the above description, it can be understood that when a wide rectangular diaphragm is used for vibration in the stripes mode, referring to FIG. 3, the length is required to have a value of $N = 8, 10 \ldots$ etc., and the width is required to have a value of $N = 7.5, 9.5 \ldots$ etc. The experimental results can be applied to the theoretical equations (1) and (2) to express the length $l_L$ of the stripes mode vibration rectangular diaphragm and the width $l_W$ thereof by the theoretical equations (5) and (6). Accordingly, all that is necessary is to make the rectangular diaphragm with a length $l_L$ and a width $l_W$ determined from the above results. According to the experiments of the inventors, any combination in the range of $N = 6$ to 30 and $N' = 3$ to 9 can be manufactured.

As described hereinabove, the method of the invention can provide a rectangular diaphragm which produce vibration in the stripes mode without any compensation such as required in the so-called cut and try method.

The method of manufacturing the rectangular diaphragm of the present invention will be described in further detail.

First, in order to determine the physical constant $C_D$ peculiar to the rectangular diaphragm to be manufactured, an optional size of experimental rectangular diaphragm which is of the same quality of material as that for the rectangular diaphragm to be manufactured is provided for the following experiments.

Namely, a hole is drilled at the center of the experimental rectangular diaphragm. In the same manner as shown in FIGS. 1 and 2, the experimental rectangular diaphragm is mounted on the small end of the horn on a vibrator and is fastened thereto with a nut. The operating frequency of the vibrator 1 is varied while the sane pattern of Mr. Ernst Florens Friedrich Chladni's chart, for example, the characteristic pattern of #100 size carborundum, on the diaphragm is being observed to find the resonance frequency $f_1$ of the experimental rectangular diaphragm when vibration in the stripes mode has occurred, and at that time the number $N_1$ of nodal lines which appear and are symmetrically positioned on both sides of the small end of the horn and are normally evenly spaced to form stripes when vibration in the stripes mode has occurred are counted. At this time, the respective values of the thickness $h_1$ of the experimental rectangular diaphragm, the length $l_1$, the resonance frequency $f_1$ and the number $N_1$ of nodal lines defining the stripes are substituted into the above described theoretical equation (3) for the known rectangular cross-section bar, to obtain the physical constant $C_D$ of the experimental rectangular diaphragm. Namely, the manner of obtaining the physical constant $C_D$ in this method does not require that the above described general equation (4) for obtaining the physical constant $C_D$ be used. On the other hand, according to the above method, the physical constant $C_D$ can be obtained very correctly and easily even when the above described factors such as $\rho$, $\sigma$, and E are unknown. The equation (3), which is an equation relating to a rectangular cross section bar can be applied even to the rectangular diaphragm which is vibrating in the stripes mode. The physical constants obtained by the present inventors from the above method for a duralumin plate and phosphor-bronze plate are shown in the following table (Table 2). It has been found that the experimental errors are a minimum.

Table 2

| | Thickness h (mm) | Physical constant $C_D \times 10^5$ (cm/s) |
|---|---|---|
| Duralumin plate | 0.98 | 1.530 |
| | 0.81 | 1.543 |
| Phosphor-bronze plate | 0.51 | 1.073 |
| | 0.41 | 1.051 |
| | 0.31 | 1.037 |

A rectangular diaphragm of the same quality material, namely having the same physical constant, as that of the experimental rectangular diaphragm is manufactured according to the following procedure.

First, only a nut for fixing the diaphragm is installed on the small end of the horn on the vibrator, which is eventually to be used in combination with the rectangular diaphragm to be manufactured, and the resonance frequency $f_2$ of the vibrator with the horn thereon is measured at this time. This resonance frequency $f_2$ is used as the design frequency in the manufacturing of the rectangular diaphragm.

The proper desired values, namely, the thickness $h_2$ of the rectangular diaphragm, the number $N_2$ of the nodal lines of the vibration in the stripes mode, and the odd number $N_2'$ smaller than the number $N_2$ of the nodal lines are chosen to determine the length $l_L$ of the rectangular diaphragm and the width $l_W$ thereof from use of the physical constant $C_D$ of the experimental rectangular diaphragm and the resonance frequency $f_2$ of the vibrator with the horn in the above equations (2), (5) and (6). The rectangular diaphragm in which vibration in the stripes mode is produced is then manufactured using these values of $l_L$ and $l_W$.

The above equations (5) and (6) have been discovered by the inventors based on experiments described hereinbefore and thus the vibration in the stripes mode can be produced by the thus made rectangular diaphragm without fail.

The following table shows one embodiment of the stripes mode vibrating rectangular diaphragm manufactured from a material of each physical constant $C_D$ obtained from Table 2 equations (2), (5) and (6) for the stripes mode vibrating rectangular diaphragm, wherein the number of the nodal lines N is 14 and the odd number N' is 7. The frequency ranges set forth in the following table (Table 3) show the upper and lower limits of frequencies at which the nodal lines remain straight in the sane pattern of Mr. Ernst Florens Friedrich Chladni's chart while the frequency is being changed in small increments.

Table 3

| Resonance frequency (KHz) | Material of rectangular diaphragm | Size of rectangular diaphragm: Thickness h (mm) | Length $l_L$ (mm) | Width $l_W$ (mm) | Frequency range (KHz) |
|---|---|---|---|---|---|
| 19.00 | Duralumin plate | 0.98 | 150.1 | 77.8 | 18.960–19.072 |
| 27.90 | | 0.81 | 112.7 | 58.5 | 27.866–27.968 |
| 49.50 | | 0.51 | 56.2 | 29.1 | 49.480–49.737 |
| 71.30 | Phosphor-bronze plate | 0.41 | 41.5 | 21.5 | 71.289–71.534 |
| 95.70 | | 0.31 | 31.0 | 16.1 | 95.666–95.731 |

When the sand pattern of the Mr. Ernst Florens Friedrich Chladni's chart was observed for the rectangular diaphragm manufactured according to the above described values, the superior stripes mode type of vibration as shown in FIG. 4 was produced.

As is apparent from the above description, in the method of manufacturing the rectangular diaphragm of the ultrasonic sound source in accordance with the present invention, the physical constant is obtained by use of the equation (3) for conditions under which vibration in the stripes mode occurs in the experimental rectangular diaphragm. Even if the Young's modulus, Poisson's ratio, and the density, etc. of this material are unknown, the physical constant can be obtained easily and correctly. Furthermore, the length and width of the rectangular diaphragm are obtained by use of the equations (5) and (6), which have been newly provided by the inventors. The length and width of the rectangular diaphragm can be calculated extremely quickly and easily from the physical constant $C_D$ of the rectangular diaphragm and the resonance frequency of the operating horn. Accordingly, the rectangular diaphragm which produces the stripes mode vibration can be manufactured extremely efficiently.

Accordingly, the present invention can provide a rectangular diaphragm for the ultrasonic sound source which has superior radiation efficiency extremely easily and positively, thus making it possible to put an intense ultrasonic sound source into practical use.

Also, according to the present invention, three or four rectangular diaphragms each manufactured in the above manner and having superior radiation efficiency are secured at their respective centers to a longitudinal resonance rod which is fixed to the small end of the horn with the vibrator connected thereto in such a manner that the diaphragms are disposed at the location of the antinodes of the vibration amplitude of the horn and the longitudinal resonance rod and are parallel to each other every wavelength or half wavelength. Thus, the ultrasonic waves radiated among the rectangular diaphragms are reinforced to produce the intense ultrasonic waves from one operating source.

Furthermore, the present invention seeks to provide an ultrasonic sound source comprising means to prevent large vibration of both end portions of the diaphragm by supporting both end portions of the diaphragm with only one coupling rod yet not permitting the end portions of the diaphragm to be completely free.

The coupling rod is coupled, at its one end, to the diaphragm and at its other end, to a sound source case or to the longitudinal vibrating rod itself so as to support the both end portions of the diaphragm by the coupling rod. Also, a plurality of diaphragms may be supported by one coupling rod, and the coupling rod can be coupled to one end of another coupling rod and the other end of the other coupling rod can be coupled to the sound source case, or to the longitudinal resonance rod. The coupling between the coupling rod and the diaphragm is aligned with a node portion of a stripes mode vibration in the neighborhood of the end of the diaphragm and the contact area between the coupling rod and the diaphragm is made as small as possible so that the coupling rod will not become an obstacle to the vibration of the diaphragm.

It is preferable that the coupling between the diaphragm and the coupling rod be located on the longitudinal center line of the diaphragm and at the node portion of the stripes mode vibration and in the range of one-sixth to one-eighth of the length of the diaphragm from the end of the diaphragm. In addition, it is preferable that at the coupling point, a pair of coupling members each having a small contact area be provided on one end portion of the coupling rod to clamp the diaphragm between the coupling members.

The following experiments have proved that the employment of the three or four rectangular diaphragms makes the sound waves for the sound source more intense, thus resulting in better radiation efficiency.

FIGS. 7(*a*) and 7(*b*) show an apparatus used for the experiments. Namely, the sound source 20 is secured, by the mounting plate 21 of the horn 10, inside the receptable I and the rectangular diaphragms 12*a*, 12*b* and 12*c* are accomodated inside the receptable I for measurement of the sound field inside a receptacle II.

The dimensions $S_1$ to $S_5$ of the receptacles I and II are as follows:

| Material | acryl-plate with thickness of 5 mm. |
|---|---|
| S1 | 475 mm. |
| S2 | 310 mm. |
| S3 | 100 mm. |
| S4 | 500 mm. |
| S5 | 130 mm. |

Figure 5:
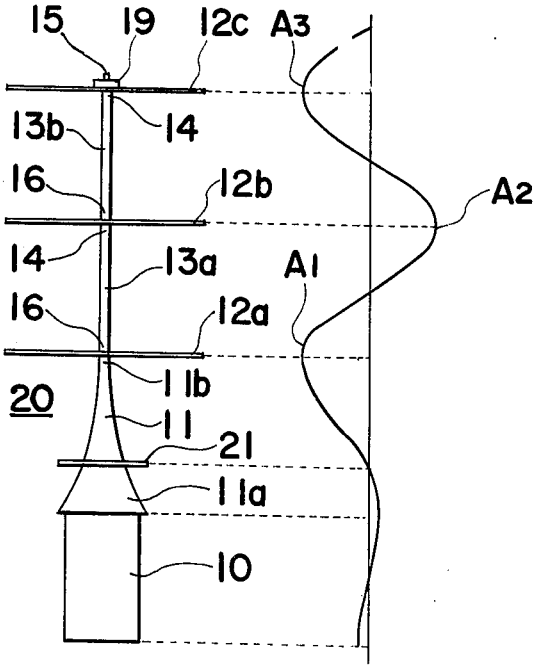
FIG. 5 is a front view of the ultrasonic sound source in accordance with the present invention.

The sound source 20 is constructed similarly to that shown in FIG. 5. The rectangular diaphragms 12*a*, 12*b*, 12*c*, and the longitudinal resonance rod 13*a* and 13*b* are detachable.

Each of the rectangular diaphragms vibrates at a frequency of 19.65 KHz in a stripes mode vibration with twenty two nodal lines. The rectangular diaphragm is made of a 234.5 mm. by 76.0 mm. duralumin plate 0.98 mm. thick and has a hole 5.0 mm. in diameter in its center.

The longitudinal resonance rods 13*a* and 13*b* are 8 mm. diameter round iron rods, which produce half wave resonance at a frequency of 19.65 KHz. The longitudinal resonance rod 13*a* is 130 mm. long while the longitudinal resonance rod 13*b* is 124 mm. long, considering the equivalent length of the nut used in the adjustment of the frequency. The vertical resonance rods 13*a* and 13*b* are, at their opposite ends, provided with male screws and female threads 5 mm. in diameter for connection and diaphragm mounting.

The horn is made of mild steel and is 160 mm. long, the large end portion and small end portion being 90 mm. and 9 mm. in diameter, respectively. The horn is an exponential horn, having an amplitude amplification factor of 10, longitudinal half wave resonance, and is connected, at its large end portion, to the vibrator.

A $\pi$ type ferrite vibrator having a frequency of 20 KHz was used as the vibrator 10 of this embodiment.

FIG. 8(I), wherein there is represented a set of frequencies, shows the results of measurements, where the number of the stripes mode vibrating diaphragms positioned along the longitudinal resonance rod in the sound source at each half wavelength of the displacement curve as shown in FIG. 5 is increased, to determine the free impedance measured from the terminal of the vibrator at small vibration amplitudes, and which shows that the diameter of the locus of motional impedance becomes smaller and the radiation efficiency becomes larger with an increased number of rectangular diaphragms.

FIG. 9 shows electro-mechanical efficiency $\eta em$, mechano-acoustical efficiency $\eta ma$, and electro-acoustical efficiency $\eta ea$, which are obtained according to the free impedance measured at small vibration amplitudes, as described hereinabove, when the number of the rectangular diaphragms was further increased gradually, and shows the tendency of the radiation efficiency to become greatest when the number of the rectangular diaphragms is three or four. Namely, it has been found that the radiation efficiency per ultrasonic sound source is best when the number of the rectangular diaphragms is three or four.

FIGS. 10(I), (II), and (III) show the results of measurements of the sound pressure distribution in the receptacle II in FIG. 7, wherein the electric input power is a constant 50 W, the number of the rectangular diaphragms is changed from one to two and then to three, respectively, a probe tube microphone being inserted into the receptacle parallel to the walls from a hole drilled in the side of the receptacle II at point *b* as shown in FIG. 7. In FIG. 10, the horizontal axis shows the position of the microphone and the vertical axis shows the output voltage of the microphone, which is proportional to the sound pressure. From the graphs it is seen that the sound pressure becomes greater and the radiation efficiency becomes higher as the number of rectangular diaphragms increases.

FIG. 8(II) shows the experimental results for the use of two rectangular diaphragms each having the same area, and which have dimensions which will allow vibration in modes I and II which are other than the stripes mode vibration. The rectangular diaphragm vibrating in the stripes mode is seen to have superior radiation efficiency, since the diameter of the locus of motional impedance where two rectangular diaphragms were used is much larger in FIG. 8(II) than the locus for two diaphragms in FIG. (I).

As is apparent from the above description, according to the present invention, each of the rectangular diaphragms is formed to satisfy a novel equation discovered by the inventors, which is necessary to produce vibration in the stripes mode in the rectangular diaphragm. Accordingly, the radiation efficiency per rectangular diaphragm is superior. Three or four rectangular diaphragms are mounted on the longitudinal resonance rod, which is connected to the small end of the horn on the vibrator, at the positions of the antinodes of the vibration amplitude and spaced from each other a full wavelength or a half wavelength, whereby the radiation efficiency per ultrasonic sound source is greatly improved.

Accordingly, the present invention provides a powerful ultrasonic sound source which is superior in radiation efficiency, thus making it possible to put the sound source into practical use for aerosol coagulation, sonic drying, etc., or in the communications field.

Referring now to FIGS. 11 to 18, there are shown sound sources 21 according to other embodiments of the present invention each comprising a completely enclosed sound source case 22, an exponential horn 23 which is secured to and extends through one-side face of the sound source case 22, a vibrator 24 which is secured to the large end portion 25 of the horn 23, longitudinal resonance rods 26*a* and 26*b* which are coupled to the small end portion 27 of the horn 23 and extend in the direction of the small end portion, and diaphragms 28*a*, 28*b* and 28*c* having rectangular shapes, respectively, each being secured at the location of an antinode of the vibration amplitude of the horn 23 and the longitudinal resonance rods 26*a* and 26*b* so that the vibrations of the vibrator 24, the horn 23 and the longitudinal resonance rods 26*a* and 26*b* are transmitted to the diaphragms 28*a*, 28*b* and 28*c* most effectively.

The connections between the diaphragms 28*a*, 28*b*, 28*c* and the horn 23, and between the diaphragms and the longitudinal resonance rods 26*a* and 26*b* are the same as in FIG. 6.

The small end portion 27 of the horn 23 and the one ends 29 of the longitudinal resonance rods 26*a* and 26*b* are formed, respectively, into male screws 30, while the other ends 31 of the longitudinal resonance rods 26*a* and 26*b* are formed into female threads. The diaphragms 28*a*, 28*b* and 28*c* have holes 33 drilled in the centers thereof, through which the male screws 30 extent. Then each of the diaphragms 28*a*, 28*b* and 28*c* is secured in parallel relation to the other diaphragms on the horn 23 and the longitudinal resonance rods 26*a* and 26*b* by tightening of the male screws 30 into the female screws and threading a nut 34 onto the male screw on the outer end of rod 26*b*.

In FIG. 11, numerals 35 and 36 designate coupling rods which are adapted to support the ends of the diaphragms near the two ends of each of the diaphragms 28*a*, 28*b* and 28*c*, respectively. A pair of coupling members 38*a* and 38*b* are additionally provided at points where the coupling rods 35 and 36 are coupled, at their one ends, to the diaphragms 28*a*, 28*b* and 28*c*.

In FIGS. 13 and 14, the coupling members 38*a* and 38*b* are provided with projections 39*a* and 39*b*, respectively, each having a narrow contact face, on the side thereof where the coupling members come into contact with the front and rear sides of diaphragms 28*a*, 28*b* and 28*c*, respectively. The end portions of the coupling rods 35 and 36 are coupled to the coupling members 38*a* and 38*b*. A pair of coupling members 38*a* and 38*b* on opposite sides of a diaphragm are mutually secured to each other by engaging screws 42*a* and 42*b* extending through holes 41*a* and 41*b*, which are drilled in the diaphragms 28*a*, 28*b* and 28*c*, respectively, into a pair of tapped holes 40*a* and 40*b* in the coupling members. Thus, the diaphragms 28*a*, 28*b* and 28*c* are adapted to be grasped between a pair of coupling members 38*a* and 38*b*. The other end of the coupling rod 35 which supports the diaphragm 28*a* is directly secured to the sound source case 22 by a nut 43.

On the other hand, the diaphragms 28*b* and 28*c* are coupled to each other by coupling rods 36, each being secured to one end 44 of a supporting rod 37, the other end of the supporting rod 37 being secured to the sound source case 22 by a nut 43.

As described hereinabove, the coupling rods 35 and 36 are coupled to points near the ends of the respective diaphragms 28*a*, 28*b* and 28*c* through the respective coupling members 38*a* and 38*b*. However, from experiments it has been found that the points are preferably located on the longitudinal center line 0—0 of the diaphragms 28*a*, 28*b* and 28*c* as shown in FIG. 17, and are aligned with the respective nodes S of the stripes mode vibration in the range of one-sixth of the entire length $l_L$ of the diaphragm to one-eighth thereof, respectively, from the ends of the diaphragm. Namely, the coupling points if they are at other than the node portions of the stripes mode vibration can not prevent the intense irregular vibration of the diaphragm and become obstacles to the vibration of the diaphragm. Also, if the coupling points are near the center of the above range even if they are aligned with the node portions of the stripes mode vibration, they can not prevent the intense irregular vibration of the vibrating end portions. Also, if the coupling points are outside of the above range they will oppose such regular vibration.

In the embodiment of FIG. 11, the points near the ends of the diaphragms are adapted to be coupled to and supported by the sound source case 22 through the coupling rods 35 or coupling rods 36 and supporting rods 37. As shown in the embodiment of FIGS. 12, 15 and 16, the points near the ends of the diaphragms can be coupled to and supported by the longitudinal resonance rods themselves through the coupling rods. The latter embodiments have the same construction as the former embodiment in that the points near the ends of the diaphragms are coupled through the coupling rods.

In the latter embodiment, the points near both ends of the diaphragms 28*a* and 28*b* are coupled to each other by a pair of coupling rods 45, while the locations near both ends of the diaphragms 28*b* and 28*c* are coupled to each other by a pair of coupling rods 46. Furthermore, the coupling rods 45 and 46 are coupled to the longitudinal resonance rods 26*a* and 26*b*, respectively, through supporting rods 47 and 48. The connections between the diaphragms and coupling rods use the coupling members 38*a* and 38*b*, as in the former embodiment. Also, the supporting rods 47 and 48 are connected to sleeves 49 respectively so that the coupling rods can be arranged in straight positions.

In this embodiment, the supporting rods 47 and 48 are coupled to the resonance rods 26*a* and 26*b* respectively. Since the longitudinal resonance rods undergo longitudinal vibration, careful consideration should be given to the connections so that the vibration will not be transmitted to the supporting rods 47 and 48. Accordingly, the supporting rods 47 and 48 are required, at their one ends, to be secured respectively to the locations of the vibration nodes of the longitudinal resonance rods 26*a* and 26*b*, namely, at locations halfway between the diaphragms.

In addition, to completely avoid the influences of vibration of the longitudinal resonance rods, it is desirable to secure the supporting rods as shown in FIG. 15 or in FIG. 16.

Sleeves 49 each having an inner diameter somewhat larger than the outer diameter of each resonance rod 26*a* and 26*b* are engaged, respectively, around the central portions, i.e., node portions, of the longitudinal resonance rods 26*a* and 26*b*. The threaded portions 50 which are formed at the end portions of the supporting rods 47 and 48 are screwed into tapped holes 51 in the sleeves 49 respectively. The respective pointed ends of the screws may penetrate slightly into the outer peripheral faces of the longitudinal resonance rods 26*a* and 26*b* respectively. Space A is left between the sleeves 49 and the outer peripheral faces of the longitudinal resonance rods 26*a* and 26*b* to keep the sleeves away from the peripheral faces. Such a construction as described hereinabove prevents the vibration of the longitudinal resonance rods 26*a* and 26*b* from being transmitted to the supporting rods 47 and 48. Accordingly, the points near both ends of the diaphragms can be kept stationary. The other ends of the supporting rods 47 and 48 are securely fixed as in the coupling between the coupling rods and supporting rods 36 and 37 in the former embodiment.

Referring to FIG. 15, the pointed ends of the supporting rods 47 and 48 are in direct contact with the longitudinal resonance rods 26*a* and 26*b*, respectively. However, as shown in FIG. 16, the supporting rods 47 and 48 can be screwed into tapped holes 52 in the sleeves 49, respectively, while screws 53*a*, 53*b* and 53*c* can be screwed into tapped holes 54*a*, 54*b* and 54*c* in the each sleeve respectively. The respective pointed ends thereof can be engaged with the outer peripheral face of the longitudinal resonance rods 26*a* and 26*b* to provide space A between the resonance rods and the sleeves 49.

FIG. 18 shows an experimental apparatus which is a partially modified version of the embodiment of FIG. 11 in which there is provided a further longitudinal resonance rod 26*c* connected with the end of the longitudinal resonance rod 26*b*.

The dimensions of the experimental apparatus will be described hereinafter.

1. diaphragms 28*a*, 28*b*, 28*c*
duralumin plate (383.7 mm. × 98 mm. × 0.98 mm.) which produces vibration in the stripes mode having 36 nodal lines at a frequency of 19.65 KHz.
2. longitudinal resonance rods 26*a*, 26*b*, 26*c*
$l_2$ = 130 mm.
$l_3$ = 130 mm.
$l_4$ = 130 mm.
outer diameter = 8 mm.
3. exponential horn 23
amplitude amplification factor = 10
$l_1$ = 160 mm.
outer diameter of large end portion = 90 mm.
outer diameter of small end portion = 9 mm.
4. $\pi$ type ferrite vibrator 24
resonance frequency = 20 KHz
5. coupling members 38*a*, 38*b* each having a rectangular cross-section of 0.5 mm. × 3 mm.

An experiment conducted with the apparatus, of FIG. 18, having the above dimensions resulted in no cracks in the diaphragms when the input power to the vibrator was increased up to 350 W. On the other hand, in a conventional system wherein no crack-preventing apparatus is provided, 200 W. was the upper limit. Thus, it was confirmed that the crack-preventing apparatus in accordance with the present invention had a great effect.

As is apparent from the description of the above embodiment and the description of the experimental device in the present invention, the diaphragms are, at points near both ends thereof, coupled to and supported by coupling rods, respectively. The diaphragms are coupled to the coupling rods so that the vibrations of the diaphragms will not be transmitted to the coupling rods. Thus both end portions of the diaphragms are supported without creating obstacles to the vibration of the diaphragms. The intense irregular vibrations of both end portions can be prevented, thus preventing cracks from being formed. Accordingly, a large input power can be applied to the vibrator, thus providing a powerful ultrasonic sound source.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is:

1. A method of manufacturing a rectangular diaphragm of a specific material quality for mounting at its center on the small end of a horn provided with a vibrator as an ultrasonic sound source, said method comprising the steps of obtaining the physical constant $C_D$ peculiar to the material from which the rectangular diaphragm is to be made by forming an experimental rectangular diaphragm of the same material as said rectangular diaphragm and which will vibrate in the stripes mode and having a length $l_1$ in a direction perpendicular to the nodal lines of the stripes mode of vibration, and a thickness $h_1$, vibrating said experimental diaphragm at a resonant frequency $f_1$ for a producing a number $N_1$ of nodal lines in the stripes mode of vibration, solving for the value $C_D$ the equation:

$$C_D = \frac{2f \cdot l^2}{(N - \frac{1}{2})^2 \cdot \pi \cdot h}$$

wherein $N$ is the number of the even-numbered nodal lines of the stripes mode, $h$ is the thickness of rectangular diaphragm, $f$ is the resonance frequency, and $l$ is the length of the rectangular diaphragm in a direction perpendicular to the nodal lines of the stripes mode vibration, and obtaining the length $l_L$ and the width $l_W$ of the desired rectangular diaphragm by substituting the physical constant $C_D$ and the resonance frequency $f_2$ of the horn of the vibrator to be provided with said diaphragm and a particular thickness $h_2$, the number $N_2$ of even-numbered nodal lines, and the odd-number $N'_2$ into the following equations for the flexural vibration of the rectangular diaphragm, $$l_L = (N - \tfrac{1}{2}) \cdot \{\frac{\pi \cdot C_D \cdot h}{2_f}\}^{\frac{1}{2}}$$

$$l_W = N' \cdot \{\frac{\pi \cdot C_D \cdot h}{2_f}\}^{\frac{1}{2}}$$

wherein $l_L$ is the length of the rectangular diaphragm in a direction perpendicular to the nodal lines of the stripes mode vibration; $l_W$ is the width of the rectangular diaphragm along the direction of the nodal lines of the stripes mode vibration; $h$ is the thickness of the rectangular diaphragm; $f$ is the resonance frequency; $N$ is the desired number of even numbered nodal lines of the stripes mode vibration; and N' is an optional number of odd number nodal lines and is smaller than the N, and forming the rectangular diaphragm with the respective values of the length $l_L$, the width $l_W$ and the thickness $h_2$.

2. An ultrasonic sound source comprising a horn and a vibrator attached thereto, a longitudinal resonance rod mounted on the small end of said horn a set of rectangular diaphragms secured to said longitudinal resonance rod with the rectangular diaphragms disposed transversely of said rod, said rectangular diaphragms being fixed at positions of antinodes of the vibration amplitude of said horn and longitudinal resonance rod and spaced at multiples of ½ wavelengths of the frequency of vibration of said horn, each diaphragm having a dimension of length $l_L$ in the direction perpendicular to the nodal lines of vibration in the stripes mode and a width $l_W$ in the direction of the nodal lines according to the equations $$l_L = (N - \tfrac{1}{2}) \cdot d$$

$$l_W = N' \cdot d$$

wherein $N$ is the number of even-numbered nodal lines of the vibration in the stripes mode; $N'$ is an odd number smaller than N, and $d$ is the distance between the nodal lines of the vibration in the stripes mode.

3. An ultrasonic sound source as claimed in claim 2 wherein said diaphragms are spaced at full wavelengths.

4. An ultrasonic sound source as claimed in claim 2 wherein said one set of rectangular diaphragms has from three to four rectangular diaphragms.

5. An ultrasonic sound source as claimed in claim 2 further comprising a sound source case in which said diaphragms are enclosed and coupling rods connected to the node portions near the ends of the diaphragms and connected between at least two adjacent diaphragms for supporting the diaphragms.

6. An ultrasonic sound source as claimed in claim 5 wherein said coupling rods each have a pair of stationary members at the end thereof connected to the diaphragms, each stationary member having a narrow contact face, the pair of stationary members being disposed on opposite sides of the diaphragm and the contact faces being in contact with the diaphragm, and means connected between the stationary members for tightening the stationary members against the diaphragm for grasping the diaphragm between the pair of stationary members.

7. An ultrasonic sound source as claimed in claim 5 further comprising supporting rods connected between the coupling rods and node portions of the longitudinal resonance rod vibrating in longitudinal resonance vibration.

8. An ultrasonic sound source as claimed in claim 5 further comprising further coupling rods connected to the node portions near the ends of at least one diaphragm other than the diaphragms connected by the firstmentioned coupling rods, said further coupling rods being connected to said sound source case.

9. An ultrasonic sound source as claimed in claim 5 further comprising supporting rods connected between said coupling rods and said sound source case.

10. An ultrasonic sound source as claimed in claim 7 wherein means is provided for connecting said supporting rods to said longitudinal resonance rod, which means has a space therein around said longitudinal resonance rod for isolating the vibrations of said longitudinal resonance rod from said supporting rods.

* * * * *